US005113604A

United States Patent [19]

Vyprachticky

[11] Patent Number: 5,113,604

[45] Date of Patent: May 19, 1992

[54] CARTRIDGE MAGAZINE

[76] Inventor: Emil Vyprachticky, 7713 Webster Way, Arvada, Colo. 80003

[21] Appl. No.: 608,580

[22] Filed: Nov. 2, 1990

[51] Int. Cl.[5] ..... F41A 9/67

[52] U.S. Cl. ..... 42/50

[58] Field of Search ..... 42/50, 7, 87, 90

[56] References Cited

U.S. PATENT DOCUMENTS

| | | | |
|---|---|---|---|
| 1,299,303 | 4/1919 | Cowles | 42/50 |
| 1,351,370 | 8/1920 | Chase | 42/7 |
| 1,375,322 | 4/1921 | Rosebush | 42/7 |
| 2,383,998 | 9/1945 | Vesely | 42/50 |
| 2,396,816 | 3/1946 | Boudreau | 42/50 |
| 3,087,270 | 4/1963 | Stoner | 42/50 |
| 4,509,283 | 4/1985 | Chesnut | 42/50 |
| 4,514,922 | 5/1985 | Farrar et al. | 42/50 |
| 4,872,279 | 10/1989 | Boat | 42/90 |

*Primary Examiner*—Charles T. Jordan

*Attorney, Agent, or Firm*—Richard W. Hanes

[57] ABSTRACT

A magazine having a casing with two compartments, one for cartridges to be fired and one for spare rounds. The compartment for receiving cartridges to be fired includes an opening for receiving the cartridges, a follower, a bias spring for urging said follower in a first direction towards said opening, and a manually actuated slide for overriding the bias spring and allowing the follower to move in a second direction away from said opening for loading and unloading of the cartridges in the compartment.

7 Claims, 4 Drawing Sheets

CARTRIDGE MAGAZINE

FIELD OF THE INVENTION

The invention relates to a straight magazine for rim and center fire cartridges for guns. The magazine has a loading and unloading feature. Although adaptable to other sizes in the preferred embodiment the magazine is designed for 0.22 caliber cartridges.

BACKGROUND OF THE INVENTION

Cartridges used with firearms can be either the center-fire type or the rim-fire type, depending on the position of the "primer" in the cartridge. Typically, problems can be incurred when loading or unloading such cartridges into the associated magazine. Particularly when rim-fired cartridges are used, loading and unloading difficulties can arise as rim-fired cartridges have a rim section of greater diameter than the diameter of the main body portion of the cartridges.

In the past, such cartridges have been inserted into the magazine against the bias of a spring biassed follower; that is, when manual force is applied to a cartridge to insert it into the magazine, it was required that force be sufficient to oppose the bias of a follower. In magazines, the follower is the movable portion which exerts an upward force on the lowermost cartridge in the magazine. The follower is typically spring biased to exert such upward force. The forcing of the cartridges into the magazine against a bias has in the past resulted in damage to the cartridges. Also, jamming of the cartridges, particularly in the case of rim-fired cartridges, can easily result. Also, if the user is not forceful and careful, a rebound effect can occur because of the strong force of the biased follower. Thus, in loading, several cartridges can rebound or spring back out of the magazine. Also, proper alignment of the cartridges can be difficult when the user is attempting to overcome the bias of the follower by pushing on the cartridge to be inserted.

In unloading magazines with biased followers, the user generally pries each cartridge out of the magazine. As in loading, several cartridges may eject out of the magazine at once. The force of the biased follower will cause the ejection of the cartridges to be in an uncontrolled manner. Alternatively, in the past a user, on occasion, inverted the magazine to shake any unused cartridges free. Again, such an unloading method lacks control, and can result in damage and scattering of the cartridges.

SUMMARY OF THE INVENTION

It is an object of the instant invention to provide a magazine for gun cartridges which can be easily loaded and unloaded in a controlled manner.

It is a further object of the invention to provide a magazine for a gun which includes a biased follower for the cartridges wherein the bias of the follower can be overcome to provide easy loading and unloading of the cartridges.

Another object of the invention is to provide a gun magazine with a built-in compartment for additional space rounds.

It is a further object of the invention to provide a cartridge magazine with a clean-out door to provide access to the compartments of the magazine.

The invention relates to a magazine for holding cartridges to be fired in a compartment. The magazine also has a separate storage chamber for holding spare rounds. The compartment for the cartridges to be fired has an opening at the top, and it contains a follower biased in a first direction where it is urged toward the opening. The follower, in its biased position, also urges any loaded cartridges toward the opening.

Means are provided for moving the follower against its bias for loading and unloading of the magazine. Such means include a detent connected to the follower, and a slot on the casing in which the detent can move. A manulally movable slide is provided on the exterior of the casing. The slide is connected to the detent and moves along with the detent in a channel on the casing's exterior.

To load the cartridges to be fired into their compartment, the slide is manually pushed in a direction away from the compartment opening. This correspondingly moves the detent in its slot and the follower moves away from the opening against its bias. Upon release of the slide, the follower will move toward the opening under its bias, and also urge any loaded cartridges toward the opening.

To unload the cartridges, the slide is similarly moved to correspondingly move the follower against its bias.

The magazine is further provided with a clean-out door which also serves to provide access to the storage compartment.

DESCRIPTION OF THE PREFERRED EMBODIMENT

The instant invention provides a magazine for housing a plurality of cartridges. The invention will be described with particular reference to housing 0.22 caliber cartridges; however, it is understood that a similar magazine could be made to accommodate other sizes.

Figure 1:
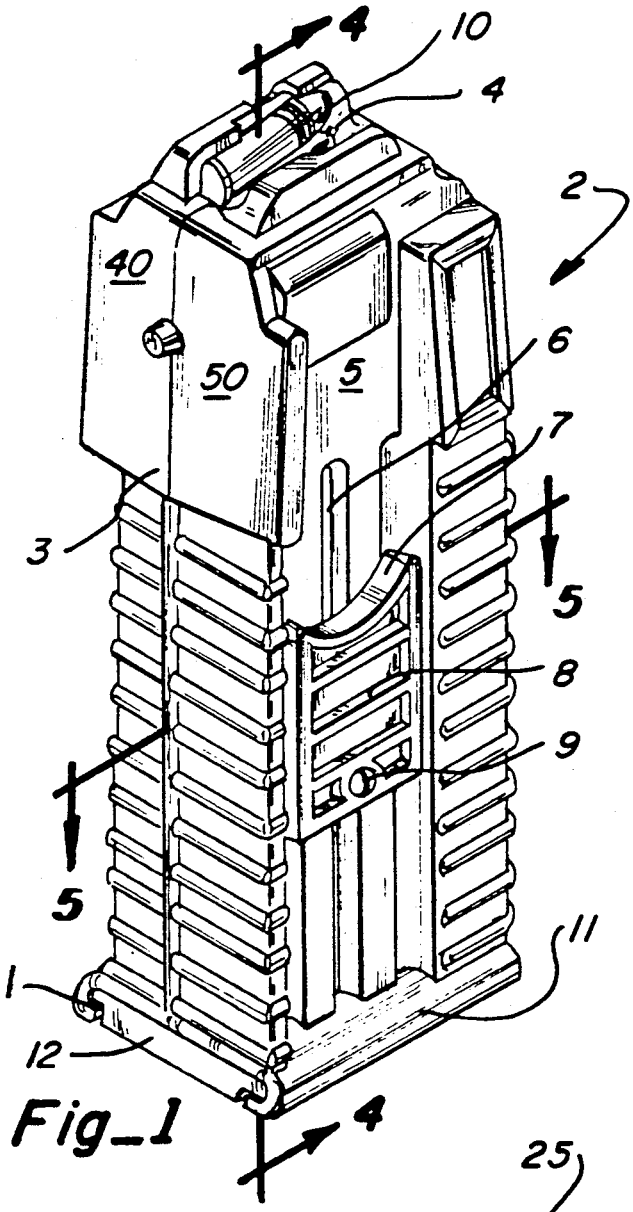
FIG. 1 is a perspective view of the magazine of the instant invention with cartridges loaded.

FIG. 1 shows the loaded magazine 2 in accordance with the instant invention.

Figure 3:
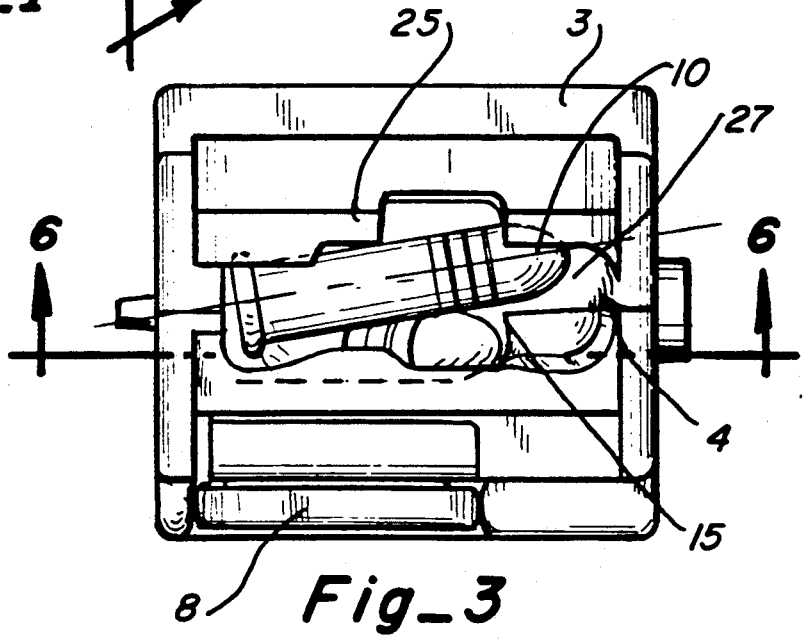
FIG. 3 is a top view of the magazine of FIG. 1 showing the cartridges in loaded position.
Figure 4:
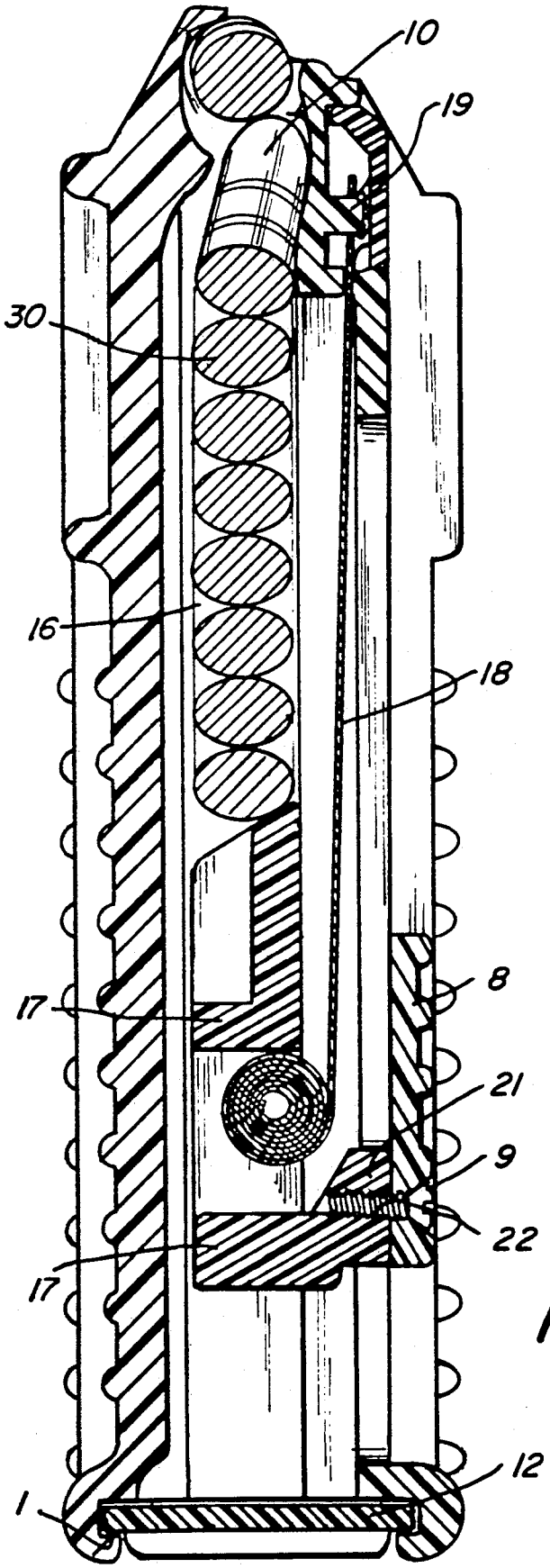
FIG. 4 is a cross-sectional view of the magazine of FIG. 1 taken along line 4—4 of FIG. 1.
Figure 5:
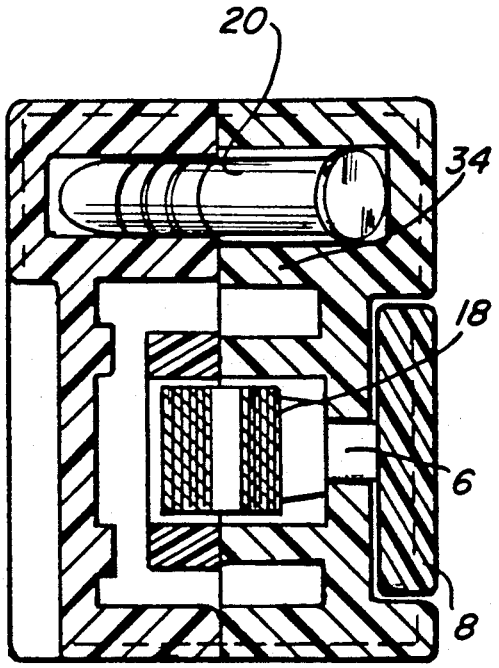
FIG. 5 is a cross-sectional view of the magazine of FIG. 1 taken along line 5—5 of FIG. 1.
Figure 9:
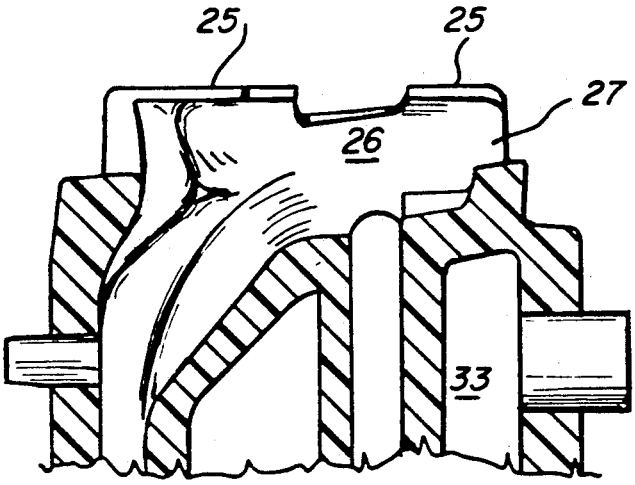
FIG. 9 is similar to FIG. 6 showing a cross-sectional view of the magazine prior to loading.
Figure 8:
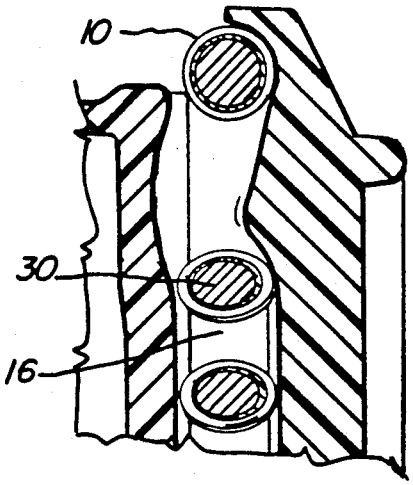
FIG. 8 is a further cross-sectional view of the magazine taken along line 8—8 of FIG. 6.

Casing 3 is made of suitable plastic type material in any well known manner. In the preferred embodiment, however, it is shown as being molded in two halves 40 and 50. The halves are fitted together by the desired number of protrusions 41 and cooperating holes 51 (See FIG. 10). The exterior of the casing is shown as having molded ridges though such are not necessary to the invention. When fitted together, the two molded halves 40 and 50 form an opening 4 at the top for insertion of cartridges to be fired as shown in FIG. 3.

Figure 6:
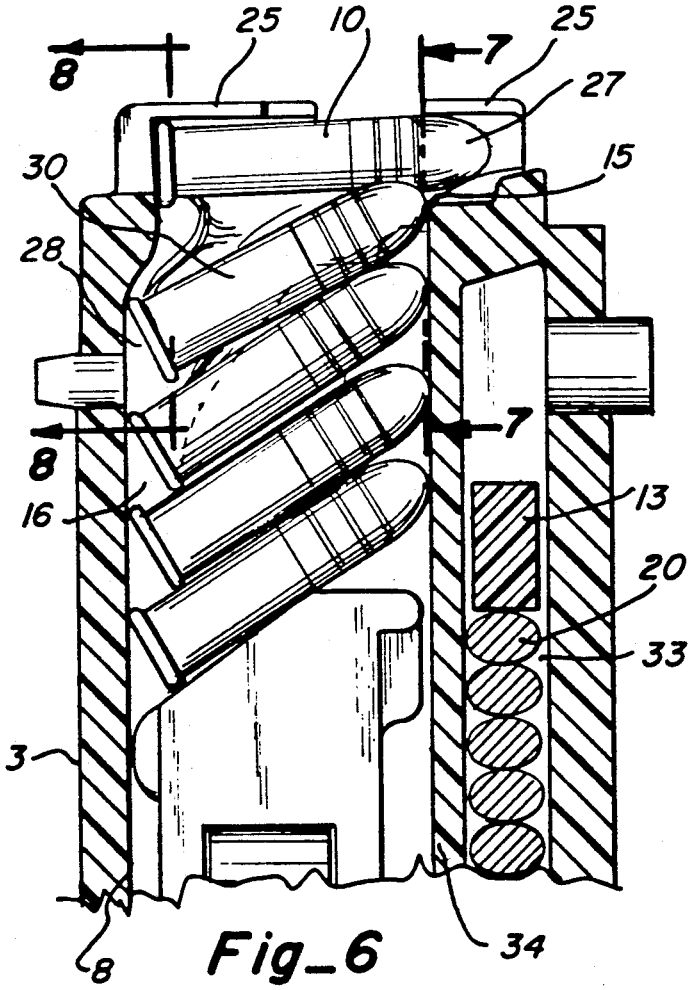
FIG. 6 is a partial cross-sectional view of the magazine taken along line 6—6 of FIG. 3.
Figure 7:
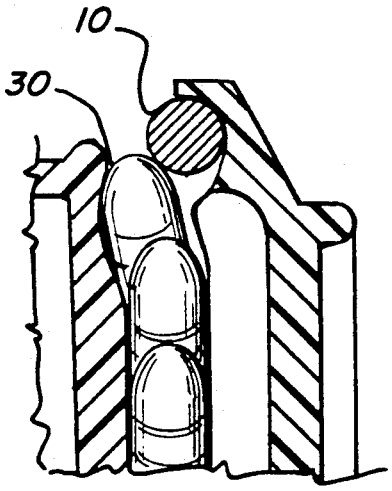
FIG. 7 is a cross-sectional view of the magazine taken along line 7—7 of FIG. 6.

The magazine casing is divided into two compartments as shown in FIG. 6. The first compartment 16 cooperates with opening 4 and is for the cartridges to be fired. The second compartment 33 is for storage of spare rounds. The compartments are such that the loaded cartridges to be fired are racked in a direction substantially perpendicular to the direction in which the spare rounds are racked.

Figure 2:
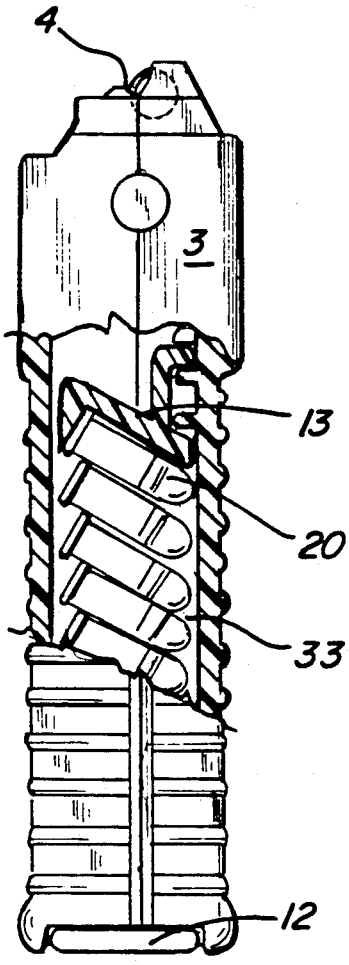
FIG. 2 is a partial cross-section of the magazine of FIG. 1 showing the storage compartment filled with space rounds.

The spare round compartment 33 includes a stop 13 for positioning of the cartridges (FIG. 2). The compartment 33 is accessible from the bottom of the casing on the side opposite the opening 4. A door 12, also used as a clean-out door (as will be later explained), provides access to the compartment 33. The spare rounds 20 are racked in the storage compartment with their noses facing downward although another racking arrangement could also be provided. Wall 34 divides the spare round compartment 33 from the compartment 16 for the cartridges to be fired.

Compartment 16 will be described with particular reference to FIGS. 3–9. The compartment 16 is shaped to hold all cartridges at an angle with respect to the next cartridge 10 to be dispensed for firing. Cartridge 10 is supported at the top portion of the casing 27. A curved portion 26 in the side wall of the casing is shaped to accommodate the cartridge 10. Guide lips 25 hold the cartridge in the dispensing position against the force of a biased follower as will be later explained. The other cartridges, the top one of which is denoted as 30, are racked at an angle with respect to cartridge 10. A wall portion 15 aids in positioning the cartridge 30 next adjacent to cartridge 10 so that cartridge 30 remains in the main body portion 28 of the compartment. Wall portion 15 prevents cartridge 30 from shifting onto the shelf formed by top portion 27, as shown in FIG. 3.

Figure 10:
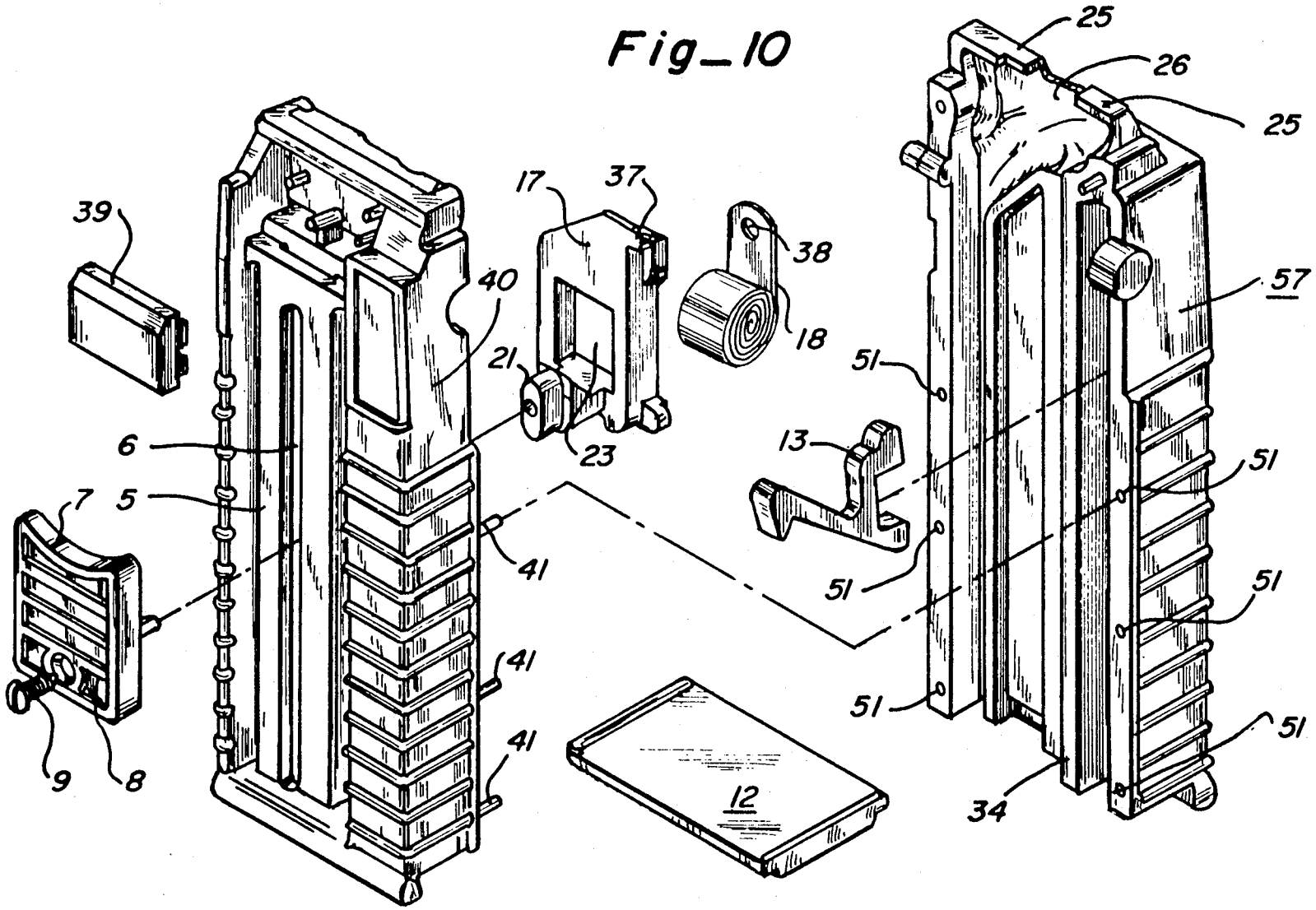
FIG. 10 is an exploded view of the unloaded magazine of the instant invention.

The loading and unloading mechanism for compartment 16 will now be described with particular reference to FIGS. 1, 4, 5 and 10. In compartment 16, all loaded cartridges are urged upward toward opening 4 by follower 17. The follower 17 may be molded of one piece construction as shown in FIG. 10 with an opening 23 which carries biasing spring 18, or it may be of two-piece construction as is well known. Follower 17 has a surface 37 for impinging on the bottommost loaded cartridge for urging all cartridges toward opening 4. A constant force coiled spring 18 which is carried in aperture 23 biases the follower upward toward opening 4. The other end of spring 18 is attached at 38 to the magazine casing 3. Block 39 covers the attachment for the spring 18 in the finished magazine. A detent 21 attached to follower 17 rides in slot 6 on the casing 3. A slide 8 having thumb impression 7 is attached to detent 21 by means of screw 9 or any other well known fastening means. Slide 8 is movable in channel 5 on the casing 3.

The casing 3 further includes a clean-out door slidable in track 1 for providing access to both compartments. The door is opened to clean out compartment 16 and to load compartment 33.

The loading and unloading operation of compartment 16 with cartridges to be fired is as follows. Slide 8 will be depressed by the thumb of the user and moved in channel 5 in a direction away from opening 4. This will in turn correspondingly move connected detent 21 in slot 6 and attached follower 17. Thus, movement and release of follower 17 in a direction away from opening 4 against the bias of spring 18 will provide an open compartment 16 for loading. The cartridges will be loaded in compartment 16 through opening 4. After loading, slide 8 will be released and follower 17 will move upward to urge the cartridges upward toward opening 4 under the force of spring 18.

To unload, the same procedure is performed to release the biased follower. The finger slide will again overcome the bias of spring 18 and the force of the follower 17 on the remaining cartridges. The magazine can then be turned over and the cartridges will fall out in a controlled manner.

Although the present invention has been described with reference to a preferred embodiment, it is appreciated that further modifications can be effected within the spirit and scope of the invention. In particular, although the present invention has been described as a magazine for 0.22 caliber cartridges, it is anticipated that the features of the present invention could be utilized in magazines for use with other cartridges. It is also anticipated that the magazine could be sized to accommodate various numbers of cartridges and that a curved magazine rather than a straight one could utilize the features of the instant invention.

I claim:

1. A magazine having a casing for housing cartridges comprising;

a first cartridge holding compartment having a main body portion with sides and end walls and a first dimension between the end walls less than the length of the cartridge to be housed therein wherein the cartridges assume an inclined position to the horizontal when placed lengthwise between the end walls, a top portion attached to said main body portion, said top portion having a shelf, said shelf having a second dimension greater than said first dimension for holding the cartridge next to be dispensed on said shelf in a substantially level horizontal position, an opening in one end of said top portion for receiving and discharging cartridges, guide means for orienting a cartridge from said inclined position to said substantially horizontal level position as a cartridge passes from said main body portion to said top portion, said guide means including partial cover means located above said shelf;

movable follower means disposed in said compartment, bias means operatively connecting the follower means to a side of the compartment for urging the follower means in a first direction towards said opening in said compartment, means carried by said casing for overriding said bias means and for allowing said follower means to move in a second direction away from said opening.

2. The magazine of claim 1 comprising a second compartment for receiving cartridges to be stored.

3. The magazine of claim 1 wherein said bias means comprises a constant force spring one end of which is carried by said follower means and the other end of which is attached to said casing.

4. The magazine of claim 3 wherein said means for overriding said bias means comprises a detent attached to said follower means, a slot in said casing for carrying said detent for movement in said slot, and means for moving said detent in said slot.

5. The magazine of claim 4 wherein said means for moving said detent comprises a slide located in a channel on the exterior of said casing, said slide being attached to said detent, whereas movement of said slide in said channel moves said detent in said slot correspondingly.

6. The magazine of claim 2 further comprising a clean-out door for providing access to both of said compartments.

7. The magazine of claim 6 wherein said guide means position the cartridge next to be dispensed for firing, said casing further comprising a wall portion for positioning the cartridge next adjacent to the cartridge next to be dispensed in a position substantially in said main body portion of said magazine.

* * * * *